US010774820B2

(12) United States Patent
Brown

(10) Patent No.: US 10,774,820 B2
(45) Date of Patent: Sep. 15, 2020

(54) CRYOGENIC PUMP

(71) Applicant: Caterpillar Inc., Peoria, IL (US)

(72) Inventor: Aaron M. Brown, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 251 days.

(21) Appl. No.: 15/810,613

(22) Filed: Nov. 13, 2017

(65) Prior Publication Data

US 2019/0145392 A1 May 16, 2019

(51) Int. Cl.

| | |
|---|---|
| ***F04B 15/08*** | (2006.01) |
| ***F04B 9/127*** | (2006.01) |
| ***F04B 53/16*** | (2006.01) |
| ***F04B 23/02*** | (2006.01) |
| ***F04B 19/24*** | (2006.01) |

(52) U.S. Cl.

CPC ..... *F04B 15/08* (2013.01); *F04B 9/127* (2013.01); *F04B 19/24* (2013.01); *F04B 23/021* (2013.01); *F04B 53/16* (2013.01); *F04B 2015/081* (2013.01)

(58) Field of Classification Search

CPC ..... F04B 9/107; F04B 9/127; F04B 15/08; F04B 19/24; F04B 23/021; F04B 53/16; F04B 2015/081–0826; F04B 19/003; F04B 31/00

USPC ..... 417/207–209, 401, 402, 901; 60/513, 60/531; 62/50.2, 50.3, 50.6

See application file for complete search history.

(56) References Cited

U.S. PATENT DOCUMENTS

| | | | | |
|---|---|---|---|---|
| 2,750,753 A * | 6/1956 | Armstrong | F01L 23/00 | 62/50.6 |
| 2,976,675 A * | 3/1961 | Bonner | F02G 1/043 | 60/531 |
| 3,080,706 A * | 3/1963 | Flynn, Jr. | F02G 1/044 | 60/523 |
| 3,087,438 A * | 4/1963 | Ciesielski | F04B 19/24 | 417/207 |
| 3,170,406 A * | 2/1965 | Robertson | F02B 71/045 | 417/364 |
| 3,234,746 A * | 2/1966 | Cope | F17C 5/02 | 62/50.6 |
| 3,285,001 A * | 11/1966 | Turnblade | F04F 1/16 | 60/531 |

(Continued)

*Primary Examiner* — Alexander B Comley

(74) *Attorney, Agent, or Firm* — Hibshman Claim Construction PLLC

(57) ABSTRACT

A cryogenic pump includes a drive assembly and a pressurization assembly operatively coupled to each other. The drive assembly includes a housing having sidewall and piston slidably disposed therein, the sidewall and a first surface of piston defining expansion chamber. A fuel supply valve is provided in fluid communication with supply of liquid cryogenic fuel and configured to selectively provide liquid cryogenic fuel into expansion chamber. A heating element extends at least partially into expansion chamber to heat and facilitate vaporization of liquid cryogenic fuel, thereby increasing pressure within expansion chamber and causing movement of piston in first direction. The pressurization assembly includes barrel defining bore and a plunger slidably disposed therein to define pressurization chamber for receiving liquid cryogenic fuel. The plunger is driven by the piston such that the movement of piston in first direction causes movement of plunger to pressurize cryogenic fuel within pressurization chamber.

19 Claims, 4 Drawing Sheets

(56) References Cited

U.S. PATENT DOCUMENTS 3,367,271 A * 2/1968 Wilson ..... F01L 21/02 417/401
3,678,686 A * 7/1972 Buck ..... F02G 1/0435 60/521
3,688,512 A * 9/1972 Prast ..... F25B 9/14 62/6
3,807,904 A * 4/1974 Schuman ..... F01B 11/00 417/207
3,902,263 A * 9/1975 Schuman ..... F01B 11/00 60/517
3,956,894 A * 5/1976 Tibbs ..... F02G 1/02 60/508
3,990,816 A * 11/1976 Kohler ..... F04B 9/042 417/536
4,051,877 A * 10/1977 Fletcher ..... F04B 9/127 141/4
4,057,961 A * 11/1977 Payne ..... B63H 11/12 60/221
4,338,065 A * 7/1982 Desor ..... F04B 19/24 219/511
4,390,325 A * 6/1983 Elo ..... F03G 6/00 417/379
4,502,847 A * 3/1985 Pozniak ..... F04B 35/002 417/380
4,639,197 A * 1/1987 Tornare ..... F04B 3/00 417/259
4,684,465 A * 8/1987 Leaseburge ..... G01N 30/28 210/101
4,792,289 A * 12/1988 Nieratschker ..... F04B 15/08 417/259
4,981,014 A * 1/1991 Gallagher ..... F01B 29/02 185/32
5,411,374 A * 5/1995 Gram ..... F04B 15/06 141/18
5,881,801 A * 3/1999 Hayakawa ..... F02G 1/00 165/104.24
6,272,855 B1 * 8/2001 Leonardi ..... F01B 17/022 60/513
6,640,556 B2 * 11/2003 Ursan ..... F04B 15/08 62/50.6
6,659,730 B2 * 12/2003 Gram ..... F04B 15/08 417/53
6,663,350 B2 * 12/2003 Tyree, Jr. ..... F04B 5/00 417/213
7,603,858 B2 10/2009 Bennett
9,228,574 B2 * 1/2016 Puckett ..... F04B 9/10
2008/0213110 A1 9/2008 Adler
2009/0129946 A1 * 5/2009 Toubia ..... F04B 15/08 417/208
2012/0317995 A1 * 12/2012 Brunnhofer ..... F02M 21/0221 62/45.1
2014/0109600 A1 * 4/2014 Lefevre ..... F04B 15/08 62/50.6

* cited by examiner

CRYOGENIC PUMP

TECHNICAL FIELD

The present disclosure relates to a cryogenic pump for an engine fuel system. More particularly, the present disclosure relates to a drive arrangement for the cryogenic pump.

BACKGROUND

Cryogenic pumps are commonly used to pressurize a cryogenic liquid for use. For example, a cryogenic pump may be used to pressurize a cryogenic liquid, such as liquid natural gas (LNG), to be vaporized and used as fuel in an internal combustion engine. A vaporizer transfers heat to the fuel, converting the fuel from liquid state to gaseous state before supplying it to the engine. The cryogenic pump typically includes plungers or pistons to pressurize the liquid fuel. These plungers or pistons may be actuated or driven by mechanical or hydraulic actuators either directly or through additional components, such as push rods. Cryogenic pumps typically employ one or more seals to inhibit leakage of the cryogenic liquid past the plunger or piston. However, these seals are susceptible to damage from debris, which may eventually cause a leakage of the cryogenic liquid outside the pumping chamber, thereby reducing the efficiency of the pump, which is undesirable.

US Patent Publication no. 2008/0213110 (hereinafter referred to as the '110 publication) relates to an apparatus and method for pressurizing a cryogenic media. The '110 publication describes a compressor including a compressor chamber surrounded by a cylinder wall in which a compressor piston is moved in a linear manner, a suction valve and a pressure valve, which are arranged in the region of the lower end position of the compressor piston, and a liquid chamber which at least partially surrounds the compressor chamber. The cylinder wall defines at least one opening, which corresponds to the liquid chamber, and at least one opening, via which the gaseous medium can be extracted from the compressor chamber, where the openings are located at points on the cylinder wall that are passed by the compressor piston.

SUMMARY

In one aspect, a cryogenic pump for a fuel system of an engine is provided. The cryogenic pump includes a drive assembly and a pressurization assembly operatively coupled to the drive assembly. The drive assembly includes a housing having a sidewall and a piston slidably disposed within the housing. The sidewall and a first surface of the piston define an expansion chamber within the housing. The drive assembly further includes a fuel supply valve in fluid communication with a supply of liquid cryogenic fuel and configured to selectively provide liquid cryogenic fuel into the expansion chamber. Further, the drive assembly includes a heating element extending at least partially into the expansion chamber and configured to introduce thermal energy into the expansion chamber, thereby facilitating vaporization of the liquid cryogenic fuel. Vaporization of the liquid cryogenic fuel increases a pressure inside the expansion chamber causing the piston to move in a first direction. The pressurization assembly includes a barrel defining a bore and a plunger slidably disposed within the bore. The plunger defines a pressurization chamber within the bore. The pressurization chamber is configured to receive liquid cryogenic fuel therein. The plunger is operatively coupled to and driven by the piston. The movement of the piston in the first direction causes movement of the plunger to pressurize the cryogenic fuel within the pressurization chamber.

In another aspect of the present disclosure, a fuel system, for supplying a cryogenic fuel to an engine, is provided. The fuel system includes a cryogenic fuel tank and a cryogenic pump disposed within the cryogenic fuel tank. The cryogenic pump includes a drive assembly and a pressurization assembly operatively coupled to the drive assembly. The drive assembly includes a housing having a sidewall and a piston slidably disposed within the housing. The sidewall and a first surface of the piston define an expansion chamber within the housing. The drive assembly further includes a fuel supply valve in fluid communication with the cryogenic fuel tank and configured to selectively provide liquid cryogenic fuel into the expansion chamber. Further, the drive assembly includes a heating element extending at least partially into the expansion chamber and configured to introduce thermal energy into the expansion chamber, thereby facilitating vaporization of the liquid cryogenic fuel. Vaporization of the liquid cryogenic fuel increases a pressure inside the expansion chamber causing the piston to move in a first direction. The pressurization assembly includes a barrel defining a bore and a plunger slidably disposed within the bore. The plunger defines a pressurization chamber within the bore. The pressurization chamber is configured to receive liquid cryogenic fuel therein. The plunger is operatively coupled to and driven by the piston. The movement of the piston in the first direction causes movement of the plunger to pressurize the cryogenic fuel within the pressurization chamber.

In a yet another aspect of the present disclosure, an engine system is provided. The engine system includes an engine and a fuel system configured to supply cryogenic fuel to the engine. The fuel system includes a cryogenic fuel tank and a cryogenic pump disposed within the cryogenic fuel tank. The cryogenic pump includes a drive assembly and a pressurization assembly operatively coupled to the drive assembly. The drive assembly includes a housing having a sidewall and a piston slidably disposed within the housing. The sidewall and a first surface of the piston define an expansion chamber within the housing. The drive assembly further includes a fuel supply valve in fluid communication with the cryogenic fuel tank and configured to provide liquid cryogenic fuel into the expansion chamber. Further, the drive assembly includes a heating element extending at least partially into the expansion chamber and configured to introduce thermal energy into the expansion chamber, thereby facilitating vaporization of the liquid cryogenic fuel. Vaporization of the liquid cryogenic fuel increases a pressure inside the expansion chamber causing the piston to move in a first direction. The pressurization assembly includes a barrel defining a bore and a plunger slidably disposed within the bore. The plunger defines a pressurization chamber within the bore. The pressurization chamber is configured to receive liquid cryogenic fuel therein. The plunger is operatively coupled to and driven by the piston. The movement of the piston in the first direction causes movement of the plunger to pressurize the cryogenic fuel within the pressurization chamber.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

Figure 1:
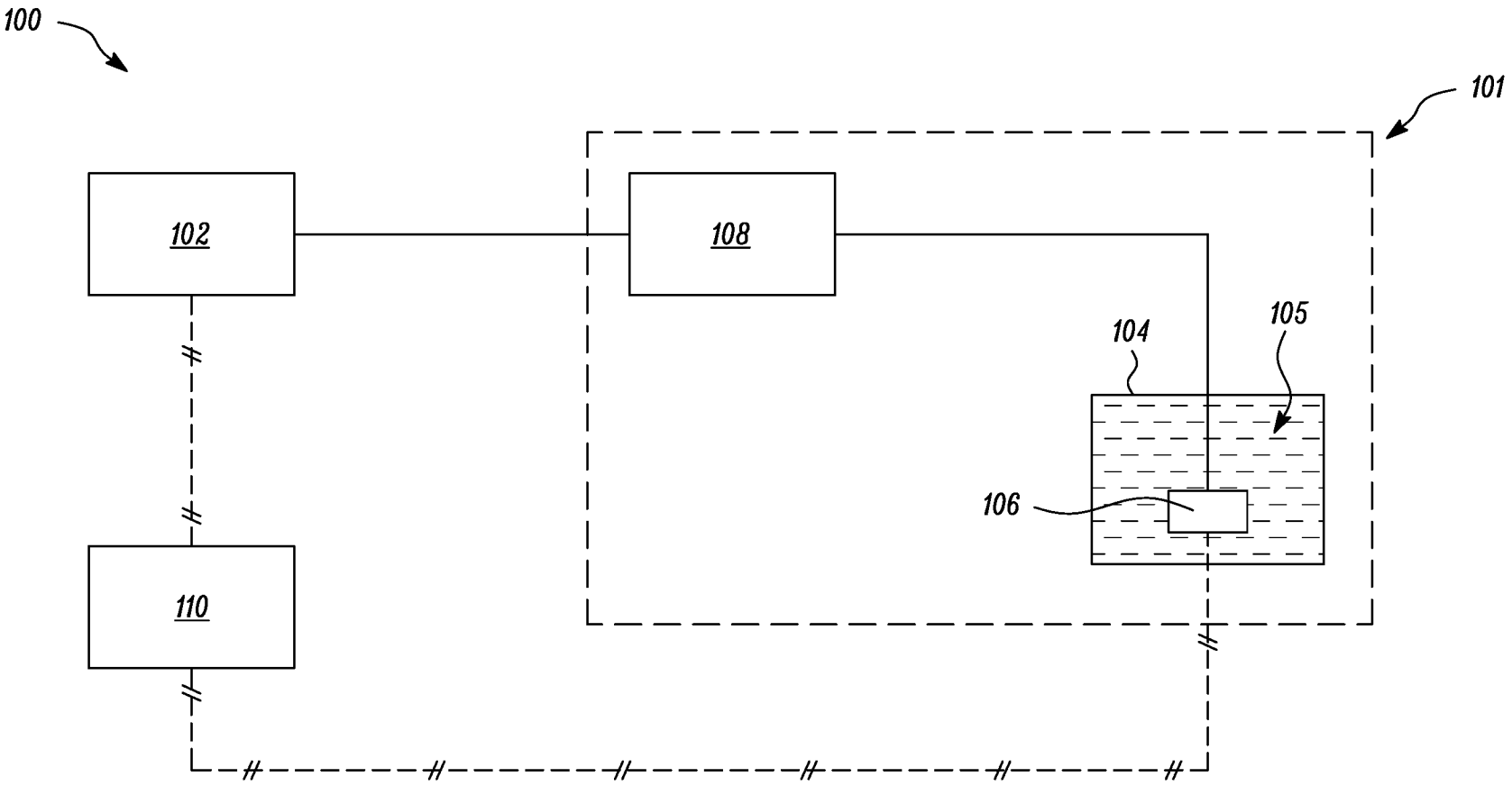
FIG. 1 is a schematic illustration of an exemplary engine system having a fuel system for supplying fuel to an engine, in accordance with an embodiment of the present disclosure.

The present disclosure relates to a cryogenic pump for a cryogenic fuel system of an engine. FIG. 1 illustrates a schematic illustration of an exemplary engine system 100 including a fuel system 101 for supplying fuel to an engine 102. The fuel system 101 is configured as a cryogenic fuel system for supplying a gaseous fuel, stored in cryogenically cooled liquefied state, to the engine 102.

The engine 102 may be mounted on a machine (not shown), such as a mining truck, a dump truck, a locomotive or the like. The engine 102 may be powered at least partly or fully by gaseous fuel, such as liquefied natural gas (LNG). In some implementations, the engine 102 may be a high-pressure natural gas engine that is configured to receive a quantity of gas by direct injection. In general, the engine 102 may use natural gas, propane gas, hydrogen gas, or any other suitable gaseous fuel, singularly or in combination with each other, to power the engine's operations. Alternatively, the engine 102 may be based on a dual-fuel engine system, or a spark ignited engine system. The engine 102 may embody a V-type, an in-line, or a varied configuration as is conventionally known. The engine 102 may be a multi-cylinder engine, although aspects of the present disclosure are applicable to engines with a single cylinder as well. Further, the engine 102 may be one of a two-stroke engine, a four-stroke engine, or a six-stroke engine. Although these configurations are disclosed, aspects of the present disclosure need not be limited to any particular engine type. For the sake of brevity, operation and other functional aspects of the conventionally known engines are not described in greater detail herein.

Referring to FIG. 1, the fuel system 101 includes a supply of cryogenic fuel, such as a cryogenic fuel tank 104, a cryogenic pump 106, and a vaporizer 108. The cryogenic fuel tank 104, hereinafter referred to as the tank 104, stores the fuel in cryogenically cooled liquefied state and defines a tank storage volume 105. For example, the tank 104 may store the fuel at a cryogenic temperature around −160° C. It will be appreciated that the temperature for storing the liquid fuel as described herein is merely exemplary and that other storage temperatures are also possible without deviating from the scope of the disclosed subject matter. The tank 104 may include an insulated, single or multi-walled configuration. For example, in the multi-walled configuration, the tank 104 may include an inner tank wall, an outer tank wall and an isolating material or a vacuum jacket provided between the inner tank wall and the outer tank wall (not shown). The structural configuration of the tank 104 is configured to insulate the tank 104 from external temperatures, thereby maintaining the liquid fuel in cryogenically cooled liquefied state.

The cryogenic pump 106, hereinafter referred to as the pump 106, is configured to pressurize and deliver the liquid fuel from the tank 104 to the vaporizer 108. In an embodiment of the present disclosure, the pump 106 is a reciprocating piston type pump explained in further detail with reference to the FIGS. 2 through 4. Operational speed of the pump 106 is controlled based on a fuel demand of the engine 102. The fuel demand of the engine 102 may be understood as an amount of fuel required by the engine 102 to produce a desired amount of power. The pump 106 is operated within a range of predefined maximum and minimum operational speeds in order to adjust the discharge output of the pump 106 based on the fuel demand of the engine 102.

Furthermore, the fuel system 101 may include a controller 110 operatively coupled to the various components of the fuel system 101 (as shown by the broken lines in FIG. 1), including the pump 106 and the engine 102. The controller 110 disclosed herein may include various software and/or hardware components that are configured to perform functions consistent with the present disclosure. As such, the controller 110 of the present disclosure may be a stand-alone controller or may be configured to co-operate in conjunction with an existing electronic control module (ECM) of a vehicle to perform functions consistent with the present disclosure. Further, the controller 110 may embody a single microprocessor or multiple microprocessors that include components for selectively controlling operations of the fuel system 101 based on a number of operational parameters associated with the fuel system 101.

According to an embodiment of the present disclosure, the controller 110 may determine the fuel demand of the engine 102 based on one or more operational parameters associated with the engine 102, such as engine load, speed, torque, etc. The controller 110 may further determine a mass and/or a volumetric flow rate of the fuel that the engine 102 requires for producing a desired power output. The controller 110 accordingly may operate the pump 106 based on the determined mass and/or the volumetric fuel demand of the engine 102. For example, the controller 110 may adjust the speed of the pump 106 to adjust the discharge output of the pump 106. Therefore, for higher fuel demands of the engine 102, the pump 106 is run at a higher speed and for lower fuel demands of the engine 102, such as during low load and idle conditions, the pump 106 is run at a lower speed. The pump 106 may have a predefined range of rated minimum and maximum operating speed and the controller 110 operates the pump 106 within the predefined range to adjust the discharge output of the pump 106 based on the fuel demands of the engine 102.

Figure 2:
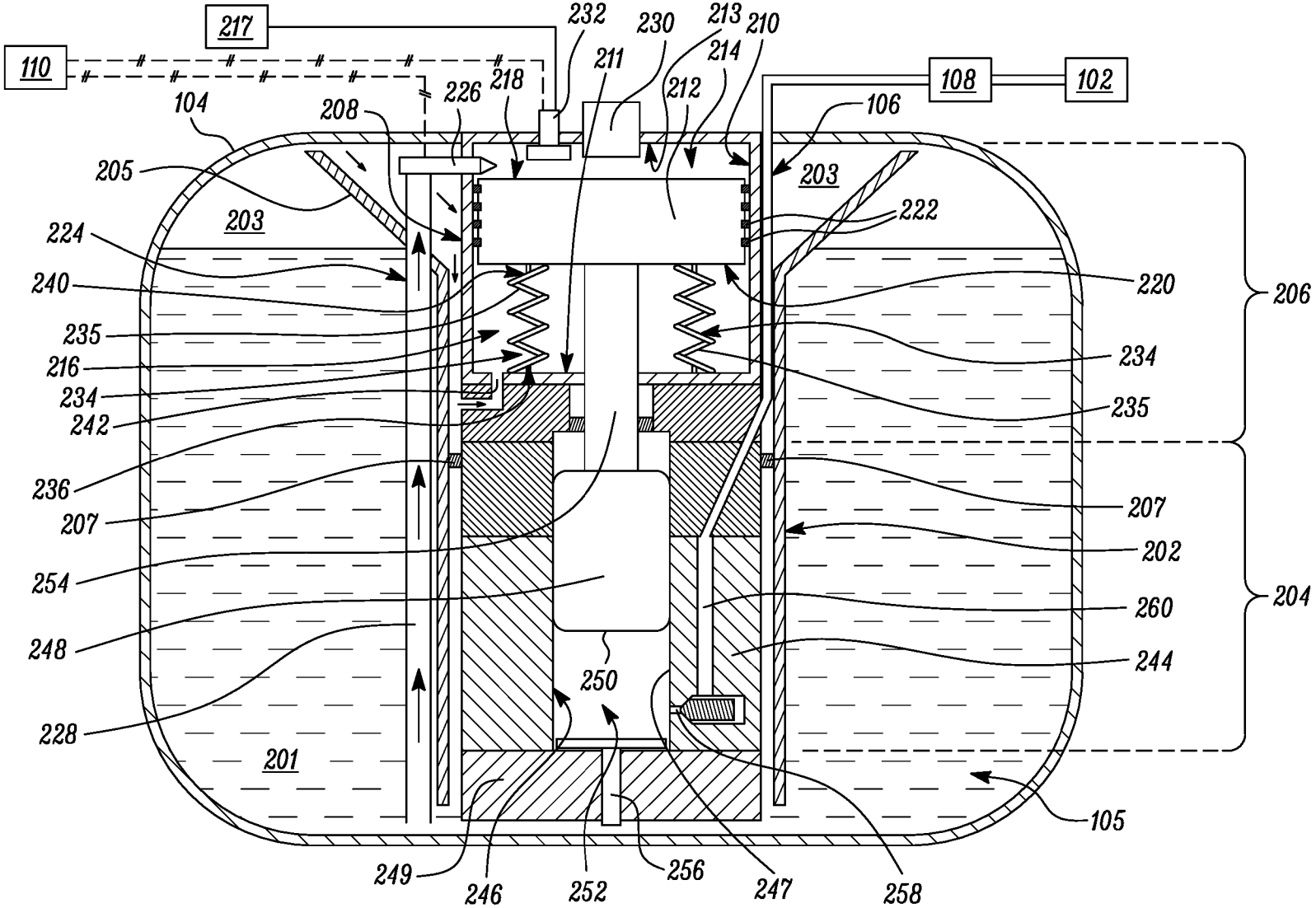
FIG. 2 is a sectional view of an exemplary cryogenic pump disposed inside a cryogenic fuel tank, in accordance with an embodiment of the present disclosure.
Figure 3:
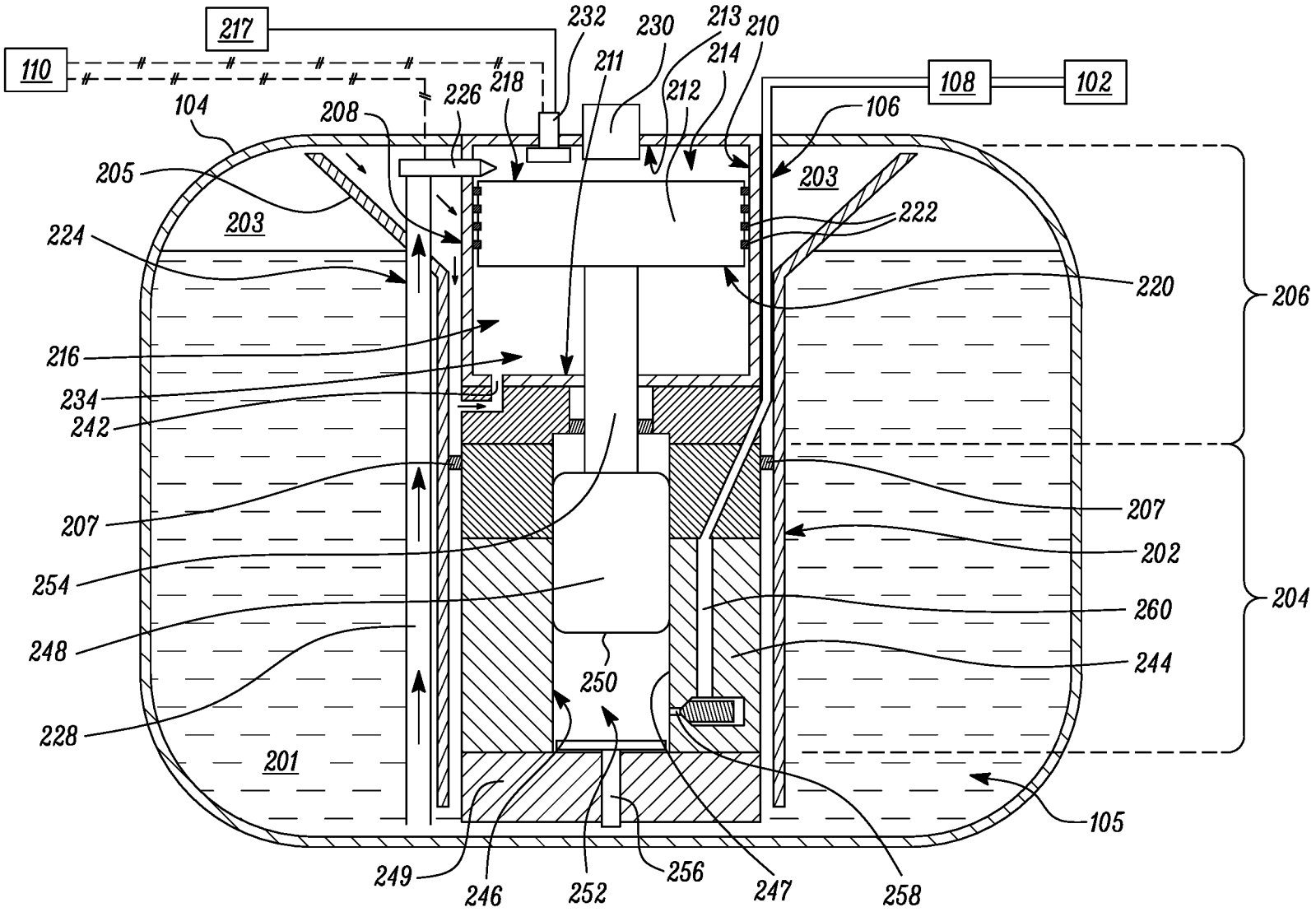
FIG. 3 is a sectional view of an exemplary cryogenic pump disposed inside the cryogenic fuel tank, in accordance with an alternative embodiment of the present disclosure.

FIG. 2 illustrates an exemplary embodiment of the pump 106 disposed inside the tank 104. FIG. 3 illustrates an alternative embodiment of the pump 106 disposed inside the tank 104. The tank 104 defines the tank storage volume 105 that is configured to store and maintain the liquid cryogenic fuel 201 in cryogenically cooled liquefied state. However, it may be contemplated that even though the tank 104 is insulated, ambient heat is naturally transferred to the tank storage volume 105, causing a portion of the liquid cryogenic fuel 201 to vaporize to a saturated vapor state 203, hereinafter referred to as the vaporized cryogenic fuel 203. The vaporized cryogenic fuel 203 and the liquid cryogenic fuel 201 gradually reach an equilibrium within the tank 104. Therefore, the tank storage volume 105 may include both the liquid cryogenic fuel 201 at the bottom as well as the vaporized cryogenic fuel 203 at the top of the tank 104.

Figure 4:
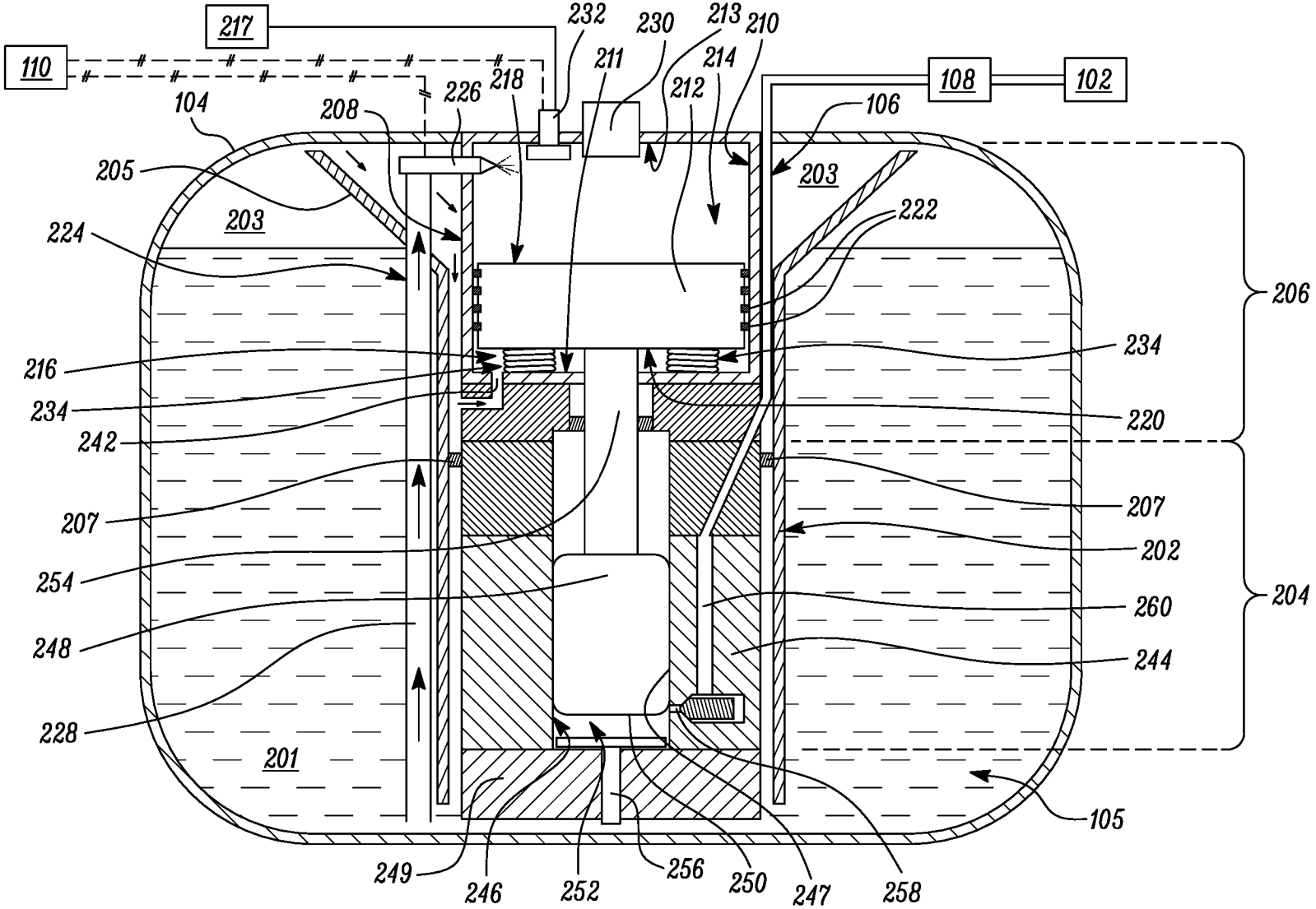
FIG. 4 is a sectional view illustrating a pressurization stroke of the cryogenic pump of FIG. 2.

As illustrated in FIGS. 2 to 4, the pump 106 is positioned inside the tank 104 within a pump socket 202. The pump socket 202 is configured to support and secure the pump 106 in place within the tank 104. In an exemplary embodiment of the present disclosure, the pump socket 202 may include a conical baffle 205. One or more liquid seals 207 may be provided between the pump socket 202 and the pump 106 to prevent liquid cryogenic fuel 201 from entering the pump socket 202.

In an embodiment of the present disclosure, the pump 106 may include a pressurization assembly 204 configured to pressurize the cryogenic fuel and a drive assembly 206 configured to drive the pressurization assembly 204. As shown in FIGS. 2 to 4, the drive assembly 206 may include a housing 208 having a sidewall 210, a first end wall 211, a second end wall 213 defining an internal volume of the housing 208. As shown in FIGS. 2 to 4, the first end wall 211 may be a bottom end wall, whereas the second end wall 213 may be a top end wall. The drive assembly 206 further includes a piston 212 slidably disposed within the housing 208, such that the piston 212 divides the internal volume of the housing 208 into an expansion chamber 214 and a buffer chamber 216.

The piston 212 is configured to reciprocate within the housing 208 between a top dead center (TDC) position (as shown in FIGS. 2 and 3) and a bottom dead center (BDC) position (as shown in FIG. 4). The piston 212 includes a first surface 218, such as a top surface or head end, and a second surface 220, such as a bottom surface or rod end. In an exemplary embodiment, the first surface 218 of the piston 212 along with the sidewall 210 and the second end wall 213 of the housing 208 defines the expansion chamber 214, and the second surface 220 of the piston 212 along with the sidewall 210 and the first end wall 211 of the housing 208 defines the buffer chamber 216. Furthermore, the drive assembly 206 may include one or more seal rings 222 disposed about the body of the piston 212 and positioned between the piston 212 and the sidewall 210, to prevent fluid communication and leakage between the expansion chamber 214 and the buffer chamber 216.

In an embodiment of the present disclosure, the drive assembly 206 may further include a cryogenic fuel injection system 224 configured to selectively provide liquid cryogenic fuel 201 into the expansion chamber 214. The cryogenic fuel injection system 224 includes a fuel supply valve 226 in fluid communication with a feed tube 228 that is in fluid communication with the tank 104. In one example, the fuel supply valve 226 may be configured as a fuel injector, a solenoid operated admission valve, a solenoid or piezoelectric actuated valve, or any other remotely controllable valve known in the art. The fuel supply valve 226 is configured to selectively provide and control a predetermined amount of liquid cryogenic fuel from the feed tube 228 to the expansion chamber 214. The cryogenic fuel injection timing, duration, and the predetermined amount of the liquid cryogenic fuel to be provided into the expansion chamber 214 may be controlled by the controller 110 based on the desired output and volumetric efficiency of the pump 106 in order to obtain a desired operational speed of the pump 106. For example, the fuel supply valve 226 may be operatively connected to the controller 110 such that controller 110 switches the fuel supply valve 226 between an ON (open) state and an OFF (closed) state according to the injection timing and the predetermined amount of cryogenic fuel to be provided to the expansion chamber 214.

In an exemplary embodiment of the present disclosure, the drive assembly 206 may further include a heating element 230 disposed on the second end wall 213 of the housing 208 and extending at least partially into the expansion chamber 214. The heating element 230 is configured to introduce thermal energy into the expansion chamber 214 and facilitate vaporization of the liquid cryogenic fuel provided/injected by the fuel supply valve 226 therein. In one example, the heating element 230 may be configured to generate heat itself, such as in case of an electrically driven heater element. In another example, heated working fluid from the engine 102 may be used as the heating element 230 to supply heat to the expansion chamber 214 and the liquid cryogenic fuel therein. Although only two examples of heating element 230 are described herein, it may be contemplated that the scope of claims is not limited to only these two examples and that any other type of heating element may also be used to achieve similar result.

When the liquid cryogenic fuel is injected into the heated expansion chamber 214, the thermal energy of the heating element 230 and the expansion chamber 214 is transferred to the liquid cryogenic fuel resulting in the vaporization of the liquid cryogenic fuel therein. The vaporization of the liquid cryogenic fuel causes an increase in pressure inside the expansion chamber 214 urging the piston 212 to move in a first direction, such as in a downward direction (as shown in FIGS. 2 to 4), to effect a pressurization stroke of the drive assembly 206. According to an exemplary embodiment of the present disclosure, the vaporization of the cryogenic fuel within the expansion chamber 214 may create a pressure of up to 4.6 mega pascals (MPa), which acting over an area of the first surface 218 of the piston 212, produces a force, causing the piston 212 to move in a first direction, such as in a downward direction.

Further, the drive assembly 206 may include an exhaust valve 232 in fluid communication with the expansion chamber 214 and an accumulator 217. In an embodiment, the exhaust valve 232 is disposed on the second end wall 213 of the housing 208, and is configured to facilitate venting of the vaporized cryogenic fuel from the expansion chamber 214 to the accumulator 217. For example, when a pressure PE within the expansion chamber 214 is greater than a pressure PA of the accumulator 217 and the exhaust valve 232 opens, the vaporized cryogenic fuel from the expansion chamber 214 is released into the low-pressure accumulator 217. From the accumulator 217, the vaporized cryogenic fuel may be further provided into air intake manifolds of the engine 102 and is used as fuel. In an embodiment, the exhaust valve 232 may also provide direct fluid communication between the expansion chamber 214 and an intake manifold (not shown) of the engine 102. The exhaust valve 232 may be operatively coupled to the controller 110, and the controller 110 may control an opening and closing of the exhaust valve 232. It may be appreciated that the exhaust valve 232 may be opened during a return stroke of the piston 212 (the drive assembly 206) to allow the exit of the vaporized cryogenic fuel from the expansion chamber 214. In an embodiment, the exhaust valve 232 may be opened when the piston 212 reaches the BDC position and remains open until the piston 212 reaches the TDC position.

The return stroke of the drive assembly 206 may be facilitated by a biasing force exerted on the second surface 220 of the piston 212 by a biasing member 234 disposed inside the buffer chamber 216. The biasing member 234 is configured to move the piston 212 to the retracted position corresponding to the TDC position. In one example, as shown in FIG. 2, the biasing member 234 may be a spring 235 having a first end 236 in contact with the first end wall 211 of the housing 208 and a second end 240 in contact with the second surface 220 of the piston 212. As the piston 212 moves towards the BDC position, the spring 235 is compressed, and therefore the spring 235 exerts the biasing force on the second surface 220 of the piston 212 to move the piston 212 towards the retracted position. However, as the force exerted on the first surface 218 of the piston 212 due to the pressure of vaporized cryogenic fuel in the expansion chamber 214 is greater than the biasing force exerted on the second surface 220 of the piston 212, the piston 212 moves in the first direction, during the pressurization stroke of the drive assembly 206. As the exhaust valve 232 is opened, the pressure of the vaporized cryogenic fuel in the expansion chamber 214 decreases due to an exit of the vaporized cryogenic fuel from the expansion chamber 214. This causes a reduction of force acting on the first surface 218 of the piston 212 to a lower value than that of the biasing force exerted on the second surface 220 of the piston 212 by the spring 235, thereby causing a movement of the piston 212 towards the retracted position.

Furthermore, in an embodiment, the drive assembly 206, in addition to the spring 235, may include a vapor inlet port 242 provided on the first end wall 211 of the housing 208 and in fluid communication with the buffer chamber 216 and the tank 104. The vapor inlet port 242 is configured to facilitate inlet of a volume V of the vaporized cryogenic fuel 203, present at the top of the tank 104, into the buffer chamber 216. The conical baffle 205 of the pump socket 202 along with the liquid seals 207 may provide a guided pathway to facilitate inlet of the vaporized cryogenic fuel 203 into the buffer chamber 216 through the vapor inlet port 242. The vaporized cryogenic fuel 203 enters the buffer chamber 216 from the top of the tank 104 until the pressure inside the buffer chamber 216 equals to the pressure inside the tank 104. In such a case, the spring 235 and the volume V of the vaporized cryogenic fuel introduced into the buffer chamber 216 through the vapor inlet port 242 collectively exert the biasing force on the second surface 220 of the piston 212 to move the piston 212 back to the retracted position after the pressurization stroke of the drive assembly 206.

Alternatively, in the embodiment illustrated in FIG. 3, only the volume V of the vaporized cryogenic fuel introduced into the buffer chamber 216 through the vapor inlet port 242 exerts the biasing force on the second surface 220 of the piston 212 to move the piston 212 back to the retracted position after the pressurization stroke of the drive assembly 206. As the exhaust valve 232 is opened at the end of the pressurization stroke of the drive assembly 206, the pressure of the vaporized cryogenic fuel in the expansion chamber 214 decreases, while the pressure of saturate vapor fuel present inside the buffer chamber 216 remains relatively constant. The decrease in the pressure inside the expansion chamber 214 causes a decrease in the force acting on the first surface 218 of the piston 212 to a magnitude less than the magnitude of the biasing force exerted on the second surface 220 of the piston 212 by the volume V of the saturate vapor fuel. In this manner, the biasing force exerted by the volume V of the vaporized cryogenic fuel on the second surface 220 of the piston 212 causes the piston 212 to move to the retracted position.

The drive assembly 206 may be operatively connected to the pressurization assembly 204 and configured to drive the pressurization assembly 204. As shown in FIGS. 2 to 4, the pressurization assembly 204 includes a barrel 244 having a bore 246 defined by an inner wall 247 and a head portion 249. Further, the pressurization assembly 204 includes a plunger 248 slidably disposed within the bore 246. As illustrated, the plunger 248 includes a plunger surface 250. The plunger surface 250 along with the inner wall 247 and the head portion 249 define a pressurization chamber 252 for pressurizing liquid cryogenic fuel to be supplied to the vaporizer 108 and subsequently to the engine 102.

The plunger 248 is operatively coupled to the piston 212 through a push rod 254 such that the movement of the piston 212 inside the housing 208 causes the movement of the plunger 248 within the bore 246. As shown in FIGS. 2 to 4, the push rod 254 is connected to the second surface 220 of the piston 212 at one end and to the plunger 248 at the other end. The plunger 248 and the barrel 244 may be paired with a matched clearance fit to minimize leakage of the liquid cryogenic fuel out of the pressurization chamber 252 and past the plunger 248. Alternatively, the plunger 248 may include one or more circumferential seals, such as the seals 222 disposed about the piston 212, described previously.

The pressurization assembly 204 may further include a fuel inlet valve 256 provided in fluid communication with the tank 104 and the pressurization chamber 252. For example, as illustrated in FIGS. 2 to 4, the fuel inlet valve 256 is provided on the head portion 249 of the barrel 244. However, the positioning of the fuel inlet valve 256 is merely exemplary and may be varied to achieve similar results. The fuel inlet valve 256 may be configured to control flow of the liquid cryogenic fuel into the pressurization chamber 252 from the tank 104. In an embodiment, the fuel inlet valve 256 may be a pressure actuated check valve configured to open and allow flow of the liquid cryogenic fuel from the tank 104 into the pressurization chamber 252 when the piston 212 and the plunger 248 move towards the retracted position (intake stroke of the pressurization assembly 204). Further, the fuel inlet valve 256 is configured to close when the pressurization chamber 252 is filled completely with the liquid cryogenic fuel and remain in closed position when the pressure within the pressurization chamber 252 increases during the pressurization stroke.

Furthermore, the pressurization assembly 204 may include a fuel discharge valve 258 in fluid communication with the pressurization chamber 252 and a discharge passage 260 defined within the barrel 244. For example, the discharge passage 260 may be provided in fluid communication with the vaporizer 108 and is configured to facilitate outlet of the pressurized liquid cryogenic fuel from the pressurization chamber 252 to the vaporizer 108, from where the gaseous fuel is subsequently supplied to the engine 102 for combustion. In an exemplary embodiment, the fuel discharge valve 258 may be a pressure actuated check valve to facilitate only outlet of the cryogenic fuel when the pressure inside the pressurization chamber 252 increases during the pressurization stroke.

INDUSTRIAL APPLICABILITY

The pump 106 according to the embodiments as disclosed herein may be used in the fuel system 101 to pressurize and supply cryogenic fuel from the tank 104 to the other components of the fuel system 101, such as the vaporizer 108 and subsequently to the engine 102. The pump 106 as disclosed herein eliminates the usage of a separate working fluid for operating the piston 212 and the plunger 248, and hence the usage of a separate seal to separate the two fluids. Therefore, the pump 106 mitigates the risk of cross contamination of the working fluids and increases the life and efficiency of the pump 106.

The operation of the pump 106 will now be described in greater detail with respect to FIGS. 2 to 4 in the following description. Initially, the piston 212 is in a retracted position corresponding to the TDC position of the piston 212 (as shown in FIG. 2 and FIG. 3). At this time, the exhaust valve 232 is in a closed position and the heating element 230 is activated to introduce the thermal energy into the expansion chamber 214.

To effect a pressurization stroke of the drive assembly 206, the fuel supply valve 226 is actuated, allowing a predetermined amount of liquid cryogenic fuel to enter into the expansion chamber 214. The controller 110 may control the operation of the fuel supply valve 226 to inject the cryogenic fuel according to the predefined injection timing and duration. As the cryogenic fuel is injected into the pre-heated expansion chamber 214, the cryogenic fuel vaporizes and results in an increase in pressure inside the expansion chamber 214. The pressure created inside the expansion chamber 214 acts on the first surface 218 of the piston 212 to produce a force F to move the piston 212 in a first direction, such as the downward direction, to effect the pressurization stroke of the drive assembly 206. It may be contemplated that the piston 212 moves towards the BDC position, thereby increasing a volume of the expansion chamber 214 and decreasing a volume of the buffer chamber 216.

The plunger 248 is operatively connected to the piston 212 by means of the push rod 254. Therefore, the downward movement of the piston 212 causes the plunger 248 also to move in the downward direction, thereby resulting in pressurization of the cryogenic fuel present in the pressurization chamber 252. This means that the pressurization stroke of the drive assembly 206 causes the pressurization stroke in the pressurization assembly 204.

As the plunger 248 pressurizes the liquid cryogenic fuel inside the pressurization chamber 252, the fuel discharge valve 258 opens to fluidly connect the pressurization chamber 252 with the discharge passage 260 and allow flow of the pressurized cryogenic fuel from the pump 106 to the other components of the fuel system 101, such as the vaporizer 108, via the discharge passage 260. Meanwhile, as the plunger 248 pressurizes the liquid cryogenic fuel within the pressurization chamber 252, the piston 212 moves towards the BDC position. Subsequently, as the piston 212 reaches the BDC position, the exhaust valve 232 is opened to fluidly connect the expansion chamber 214 to the accumulator 217, thereby allowing venting of the vaporized cryogenic fuel from the expansion chamber 214 to the accumulator 217. The gaseous cryogenic fuel, vented from the expansion chamber 214, may be provided to the accumulator 217 through a separate fluid channel (not shown), for storage and subsequent supply to the engine 102. The accumulator 217 may be at a relatively lower pressure than the expansion chamber 214, thereby causing the vaporized cryogenic fuel to flow from the high-pressure expansion chamber 214 to the low-pressure accumulator 217 when the exhaust valve 232 opens. Alternatively, the vaporized cryogenic fuel exiting from the expansion chamber 214 may be returned to the tank 104 for future utilization.

Further, as the vaporized cryogenic fuel exits the expansion chamber 214, the pressure within the expansion chamber 214 decreases thereby decreasing the force acting on the first surface 218 of the piston 212. Further, as the vaporized cryogenic fuel exits the expansion chamber 214, the pressure within the expansion chamber 214 decreases thereby causing the volume V of the vaporized cryogenic fuel 203, present in the tank 104, enter the buffer chamber 216 through the vapor inlet port 242 and exert a force on the second surface 220 of the piston 212. In this embodiment, wherein the pump 106 is embodied as pump 106*a*, the spring 235 is also connected to the second surface 220 of the piston 212, which acts as the biasing force on the piston 212. The biasing force exerted by the spring 235 acts in combination with the force exerted by the volume V of the vaporized cryogenic fuel 203 entering the buffer chamber 216 to move the piston 212 in the second direction, such as an upward direction, to move the piston 212 towards the retracted position. In an alternative embodiment, there may be no vapor inlet port 242 and the biasing force exerted by the spring 235 acts alone on the piston 212 to move it towards the retracted position.

In an alternative embodiment, as shown in FIG. 3, wherein the pump 106 is embodied as the pump 106*b*, the spring 235 may not be present in the buffer chamber 216, and the volume V of the vaporized cryogenic fuel introduced into the buffer chamber 216 through the vapor inlet port 242 acts as the sole biasing force on the second surface 220 of the piston 212, causing the piston 212 to move in the upward direction towards the retracted position.

As the piston 212 moves towards the retracted position, i.e., the TDC position during the return stroke, the plunger 248 also moves along with the piston 212 in the upward direction. The upward movement of the plunger 248 creates a vacuum inside the pressurization chamber 252 thereby causing opening of the fuel inlet valve 256 thereby allowing intake of the liquid cryogenic fuel into the pressurization chamber 252 from the tank 104. The upward movement of the plunger 248 reduces the pressure inside the pressurization chamber 252, and the pressure of the tank 104 being relatively higher causes the fuel inlet valve 256 to open and fluidly connect the tank 104 with the pressurization chamber 252 thereby allowing the liquid cryogenic fuel to flow from the tank 104 to the low-pressure pressurization chamber 252.

Subsequently, the pressurization stroke of the drive assembly 206 and the pressurization stroke of the pressurization assembly 204 may be repeated continuously, as required, to operate the pump 106 for supplying the pressurized cryogenic fuel to the vaporizer 108 and subsequently to the engine 102.

While aspects of the present disclosure have been particularly depicted and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A cryogenic pump for a fuel system of an engine, the cryogenic pump comprising:

a drive assembly including a housing having a sidewall, a piston slidably disposed within the housing, the sidewall and a first surface of the piston defining an expansion chamber within the housing, a fuel supply valve in fluid communication with a supply of a liquid cryogenic fuel and configured to selectively provide the liquid cryogenic fuel into the expansion chamber, and a heating element extending at least partially into the expansion chamber and configured to introduce thermal energy into the expansion chamber, thereby facilitating vaporization of the liquid cryogenic fuel, wherein the vaporization of the liquid cryogenic fuel increases a pressure inside the expansion chamber causing the piston to move in a first direction; and a pressurization assembly operatively coupled to the drive assembly, the pressurization assembly including a barrel defining a bore, a plunger slidably disposed within the bore and defining a pressurization chamber within the bore, the plunger being operatively coupled to and driven by the piston, and a fuel inlet valve for delivering the liquid cryogenic fuel into the pressurization chamber, the pressurization chamber being in fluid communication with the supply of the liquid cryogenic fuel via a first flow path, the first flow path extending from the supply of the liquid cryogenic fuel to the pressurization chamber, the first flow path including the fuel inlet valve, wherein the movement of the piston in the first direction causes movement of the plunger to pressurize the liquid cryogenic fuel within the pressurization chamber, wherein the expansion chamber is in fluid communication with the supply of the liquid cryogenic fuel via a second flow path, the second flow path extending from the supply of the liquid cryogenic fuel to the expansion chamber, the second flow path including the fuel supply valve, wherein the piston further includes a second surface disposed opposite to and facing away from the first surface of the piston, and wherein the drive assembly further includes a buffer chamber within the housing defined by the second surface of the piston and the sidewall, the buffer chamber being in continuous fluid communication with the supply of the liquid cryogenic fuel via a fuel vapor inlet port.

2. The cryogenic pump of claim 1, further comprising a biasing member in contact with a second surface of the piston and configured to act on the second surface of the piston to bias the piston to a retracted position.

3. The cryogenic pump of claim 2, further comprising a buffer chamber within the housing defined by the second surface of the piston and the sidewall, wherein the biasing member is a spring disposed inside the buffer chamber.

4. The cryogenic pump of claim 2, further comprising a buffer chamber within the housing defined by the second surface of the piston and the sidewall, and a vapor inlet port in fluid communication with the buffer chamber, wherein the biasing member comprises a volume of vaporized cryogenic fuel introduced into the buffer chamber through the vapor inlet port.

5. The cryogenic pump of claim 1, the pressurization assembly further including a fuel discharge valve in fluid communication with the pressurization chamber and a discharge passage defined within the barrel.

6. The cryogenic pump of claim 1, wherein the drive assembly further includes an exhaust valve in fluid communication with the expansion chamber and an accumulator.

7. The cryogenic pump of claim 1, the drive assembly further including a push rod operatively coupling the piston to the plunger.

8. The cryogenic pump of claim 1, wherein the fuel supply valve is in fluid communication with a feed tube, the feed tube being in fluid communication with a cryogenic fuel tank, and wherein the fuel supply valve is configured to selectively provide liquid cryogenic fuel from the feed tube to the expansion chamber.

9. The cryogenic pump of claim 1, wherein the second flow path consists of a feed tube and the fuel supply valve.

10. A fuel system for supplying a cryogenic fuel to an engine, the fuel system comprising:

a cryogenic fuel tank; and a cryogenic pump disposed within the cryogenic fuel tank, the cryogenic pump having a drive assembly including a housing having a sidewall, a piston slidably disposed within the housing, the sidewall and a first surface of the piston defining an expansion chamber within the housing, a fuel supply valve in fluid communication with the cryogenic fuel tank and configured to selectively provide a liquid cryogenic fuel from the cryogenic fuel tank into the expansion chamber, and a heating element extending at least partially into the expansion chamber and configured to introduce thermal energy into the expansion chamber, thereby facilitating vaporization of the liquid cryogenic fuel, wherein the vaporization of the liquid cryogenic fuel increases a pressure inside the expansion chamber causing the piston to move in a first direction; and a pressurization assembly operatively coupled to the drive assembly, the pressurization assembly including a barrel defining a bore, a plunger slidably disposed within the bore and defining a pressurization chamber within the bore, the plunger being operatively coupled to and driven by the piston, and a fuel inlet valve for delivering the liquid cryogenic fuel into the pressurization chamber, the pressurization chamber being in fluid communication with the cryogenic fuel tank via a first flow path, the first flow path extending from the cryogenic fuel tank to the pressurization chamber, the first flow path including the fuel inlet valve, wherein the movement of the piston in the first direction causes movement of the plunger to pressurize the cryogenic fuel within the pressurization chamber, wherein the expansion chamber is in fluid communication with the cryogenic fuel tank via a second flow path, the second flow path extending from the cryogenic fuel tank to the expansion chamber, the second flow path including the fuel supply valve, wherein the piston further includes a second surface disposed opposite to and facing away from the first surface of the piston, and wherein the drive assembly further includes a buffer chamber within the housing defined by the second surface of the piston and the sidewall, the buffer chamber being in continuous fluid communication with the cryogenic fuel tank via a fuel vapor inlet port.

11. The fuel system of claim 10, the cryogenic pump further comprising a biasing member in contact with a second surface of the piston and configured to act on the second surface of the piston to bias the piston to a retracted position.

12. The fuel system of claim 11, the cryogenic pump further comprising a buffer chamber within the housing defined by the second surface of the piston and the sidewall, wherein the biasing member is a spring disposed inside the buffer chamber.

13. The fuel system of claim 11, the cryogenic pump further comprising a buffer chamber within the housing defined by the second surface of the piston and the sidewall, and a vapor inlet port in fluid communication with the buffer chamber, wherein the biasing member comprises a volume of vaporized cryogenic fuel introduced into the buffer chamber through the vapor inlet port.

14. The fuel system of claim 10, the pressurization assembly further including a fuel discharge valve in fluid communication with the pressurization chamber and a discharge passage defined within the barrel.

15. The fuel system of claim 10, wherein the drive assembly further includes an exhaust valve in fluid communication with the expansion chamber and an accumulator.

16. The fuel system of claim 10, wherein the drive assembly further includes a push rod operatively coupling the piston to the plunger.

17. The fuel system of claim 10, wherein the fuel supply valve is in fluid communication with a feed tube, the feed tube being in fluid communication with the cryogenic fuel tank, and wherein the fuel supply valve is configured to selectively provide liquid cryogenic fuel from the feed tube to the expansion chamber.

18. An engine system comprising:

an engine; and a fuel system configured to supply cryogenic fuel to the engine, the fuel system including a cryogenic fuel tank; and a cryogenic pump disposed within the cryogenic fuel tank, the cryogenic pump having a drive assembly including a housing having a sidewall, a piston slidably disposed within the housing, the sidewall and a first surface of the piston defining an expansion chamber within the housing, a fuel supply valve in fluid communication with the cryogenic fuel tank and configured to selectively provide a liquid cryogenic fuel from the cryogenic fuel tank into the expansion chamber, and a heating element extending at least partially into the expansion chamber and configured to introduce thermal energy into the expansion chamber, thereby facilitating vaporization of the liquid cryogenic fuel, wherein the vaporization of the liquid cryogenic fuel increases a pressure inside the expansion chamber causing the piston to move in a first direction; and a pressurization assembly operatively coupled to the drive assembly, the pressurization assembly including a barrel defining a bore, a plunger slidably disposed within the bore and defining a pressurization chamber within the bore, the plunger being operatively coupled to and driven by the piston, and a fuel inlet valve for delivering the liquid cryogenic fuel into the pressurization chamber, the pressurization chamber being in fluid communication with the cryogenic fuel tank via a first flow path, the first flow path extending from the cryogenic fuel tank to the pressurization chamber, the first flow path including the fuel inlet valve, wherein the movement of the piston in the first direction causes movement of the plunger to pressurize the liquid cryogenic fuel within the pressurization chamber, wherein the expansion chamber is in fluid communication with the cryogenic fuel tank via a second flow path, the second flow path extending from the cryogenic fuel tank to the expansion chamber, the second flow path including the fuel supply valve, wherein the piston further includes a second surface disposed opposite to and facing away from the first surface of the piston, and wherein the drive assembly further includes a buffer chamber within the housing defined by the second surface of the piston and the sidewall, the buffer chamber being in continuous fluid communication with the cryogenic fuel tank via a fuel vapor inlet port.

19. The engine system of claim 18, the cryogenic pump further comprising a biasing member in contact with a second surface of the piston and configured to act on the second surface of the piston to bias the piston to a retracted position.

* * * * *